US007186095B2

(12) United States Patent
Skinner

(10) Patent No.: US 7,186,095 B2
(45) Date of Patent: Mar. 6, 2007

(54) COMPRESSOR MOUNTING BRACKET AND METHOD OF MAKING

(75) Inventor: Robin G. Skinner, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 689 days.

(21) Appl. No.: 10/657,382

(22) Filed: Sep. 8, 2003

(65) Prior Publication Data

US 2004/0057845 A1 Mar. 25, 2004

Related U.S. Application Data

(60) Provisional application No. 60/412,884, filed on Sep. 23, 2002.

(51) Int. Cl.
*F16M 5/00* (2006.01)

(52) U.S. Cl. ..... 417/360; 248/677

(58) Field of Classification Search ..... 417/360; 248/637, 671, 677; 62/297
See application file for complete search history.

(56) References Cited

U.S. PATENT DOCUMENTS

| | | | | |
|---|---|---|---|---|
| 1,879,458 | A * | 9/1932 | Peltier | 248/671 |
| 2,596,640 | A * | 5/1952 | Berry | 418/88 |
| 2,661,172 | A | 12/1953 | Needham | |
| 3,039,725 | A | 6/1962 | Kerley, Jr. | |
| RE25,569 | E | 5/1964 | Coron et al. | 230/117 |
| 3,145,960 | A | 8/1964 | Langdon | |
| 3,749,340 | A | 7/1973 | Williams et al. | |
| 3,785,167 | A | 1/1974 | Sahs | |
| 4,089,613 | A | 5/1978 | Babbitt, Jr. | 403/388 |
| 4,244,680 | A | 1/1981 | Ishizuka et al. | 418/97 |
| 4,389,171 | A | 6/1983 | Eber et al. | 418/15 |
| 4,416,594 | A | 11/1983 | Ichikawa | 417/360 |
| 4,497,615 | A | 2/1985 | Griffith | 417/310 |
| 4,518,276 | A | 5/1985 | Mitchell et al. | 403/13 |
| 4,552,518 | A | 11/1985 | Utter | 418/55 |
| 4,557,677 | A | 12/1985 | Hasegawa | 418/63 |
| 4,685,188 | A | 8/1987 | Goy | 29/446 |
| 4,767,293 | A | 8/1988 | Caillat et al. | 418/55 |
| 4,792,288 | A | 12/1988 | Gromoll et al. | 417/278 |
| 4,818,198 | A | 4/1989 | Tamura et al. | 418/55 |

(Continued)

FOREIGN PATENT DOCUMENTS

FR 2 755 477 A1 11/1997

(Continued)

*Primary Examiner*—Michael Koczo, Jr.
(74) *Attorney, Agent, or Firm*—Baker & Daniels LLP

(57) ABSTRACT

A mounting bracket for a compressor. The mounting bracket includes a mounting member and an elongate bracing member. The mounting member is secured to the housing of the compressor has a central support section in substantial registry with the housing. The mounting member includes two legs which extend from opposite ends of the central support section. The first and second legs respectively include first and second distal portions. The bracing member may be secured to the mounting member with two swaged connections. The swaged connections each define an aperture through the bracing member and the mounting member. A method of mounting a compressor is also provided. The method utilizes a mounting bracket having a bracing member which is secured to a mounting member by deforming at least one of the bracing member and the mounting member into engagement with the other of the bracing member and the mounting member.

6 Claims, 4 Drawing Sheets

U.S. PATENT DOCUMENTS 4,877,382 A 10/1989 Caillat et al. ..... 418/55
4,992,033 A 2/1991 Caillat et al. ..... 418/55.3
5,012,896 A 5/1991 Da Costa ..... 184/6.16
5,055,010 A 10/1991 Logan ..... 417/410
5,062,779 A 11/1991 Da Costa ..... 418/270
5,110,268 A 5/1992 Sakurai et al. ..... 417/410
5,114,322 A 5/1992 Caillat et al. ..... 418/55.6
5,137,437 A 8/1992 Machida et al. ..... 418/55.1
5,176,506 A 1/1993 Siebel ..... 417/368
5,211,031 A 5/1993 Murayama et al. ..... 62/498
RE34,297 E 6/1993 Elson ..... 417/372
5,219,281 A 6/1993 Caillat et al. ..... 418/55.6
5,222,885 A 6/1993 Cooksey ..... 418/96
5,224,845 A 7/1993 Mangyo et al. ..... 417/423.13
5,240,391 A 8/1993 Ramshankar et al. ... 417/410 R
5,247,738 A 9/1993 Yoshii ..... 29/888.022
5,312,234 A 5/1994 Yoshii ..... 418/55.1
5,345,785 A 9/1994 Sekigami et al. ..... 62/468
5,345,970 A 9/1994 Leyderman et al. ..... 137/856
5,346,375 A 9/1994 Akiyama et al. ..... 418/15
5,348,455 A 9/1994 Herrick et al. ..... 418/63
5,370,156 A 12/1994 Peracchio et al. ..... 137/856
5,391,066 A 2/1995 Sawai et al. ..... 418/55.6
5,427,511 A 6/1995 Caillat et al. ..... 418/55.1
5,474,433 A 12/1995 Chang et al. ..... 418/55.4
5,487,648 A 1/1996 Alfano et al.
5,522,715 A 6/1996 Watanabe et al. ..... 418/55.1
5,531,577 A 7/1996 Hayase et al. ..... 418/55.1
5,533,875 A 7/1996 Crum et al. ..... 417/368
5,579,651 A 12/1996 Sugiyama et al.
5,580,233 A 12/1996 Wakana et al. ..... 418/94
5,597,293 A 1/1997 Bushnell et al. ..... 417/410.3
5,597,296 A 1/1997 Akazawa et al. ..... 418/55.1
5,634,781 A 6/1997 Yoshida et al. ..... 418/55.1
5,645,408 A 7/1997 Fujio et al. ..... 418/55.4
5,660,539 A 8/1997 Matsunaga et al. ..... 418/55.6
5,683,237 A 11/1997 Hagiwara et al.
5,695,326 A 12/1997 Oka et al. ..... 418/55.1
5,716,202 A 2/1998 Koyama et al. ..... 418/55.6
5,720,601 A 2/1998 Tark et al. ..... 417/569
5,745,992 A 5/1998 Caillat et al. ..... 29/888.022
5,752,688 A * 5/1998 Campbell et al. ..... 248/674
5,769,126 A 6/1998 Cho ..... 137/856
5,772,411 A 6/1998 Crum et al. ..... 417/368
5,772,416 A 6/1998 Caillat et al. ..... 418/55.6
5,775,894 A 7/1998 Kosco, Jr. ..... 418/63
5,810,572 A 9/1998 Yamamoto et al. ..... 418/55.6
5,829,959 A 11/1998 Tsubono et al. ..... 418/55.5
5,863,190 A 1/1999 Yamamoto et al. ..... 418/55.1
5,913,892 A 6/1999 Kwon
5,931,649 A 8/1999 Caillat et al. ..... 418/55.1
5,931,650 A 8/1999 Yasu et al. ..... 418/55.3
5,947,709 A 9/1999 Koyama et al. ..... 418/55.6
5,964,581 A 10/1999 Iizuka et al. ..... 417/410.3
6,000,917 A 12/1999 Smerud et al. ..... 417/368
6,011,336 A 1/2000 Mathis et al.
6,027,321 A 2/2000 Shim et al. ..... 418/1
6,039,551 A 3/2000 Takeuchi et al. ..... 418/88
6,050,794 A 4/2000 Noboru et al. ..... 418/55.6
6,056,523 A 5/2000 Won et al. ..... 418/15
6,106,254 A 8/2000 Hirooka et al. ..... 418/55.6
6,132,191 A 10/2000 Hugenroth et al. ..... 418/55.1
6,139,291 A 10/2000 Perevozchikov ..... 418/55.1
6,156,106 A 12/2000 Kamata ..... 96/189
6,162,035 A 12/2000 Hayano et al. ..... 418/220
6,167,719 B1 1/2001 Yakumaru et al. ..... 62/468
6,171,076 B1 1/2001 Gannaway ..... 417/350
6,179,589 B1 1/2001 Bass et al. ..... 418/55.1
6,186,753 B1 2/2001 Hugenroth et al. ..... 418/55.1
6,224,356 B1 5/2001 Dewar et al. ..... 418/55.1
6,227,830 B1 5/2001 Fields et al. ..... 418/55.1
6,247,910 B1 6/2001 Yokoyama ..... 418/55.1
6,261,073 B1 7/2001 Kumazawa ..... 418/63
6,264,446 B1 7/2001 Rajendran et al.
6,280,154 B1 8/2001 Clendenin et al. ..... 417/410.5
6,299,423 B1 10/2001 Perevozchikov ..... 418/55.1
6,305,912 B1 10/2001 Svendsen et al. ..... 417/312
6,402,485 B2 6/2002 Hong et al. ..... 417/366
2001/0006603 A1 7/2001 Hong et al. ..... 418/55.1
2001/0055536 A1 12/2001 Bernardi et al. ..... 418/55.6
2006/0147314 A1* 7/2006 Haller et al. ..... 417/63

FOREIGN PATENT DOCUMENTS

JP 61087994 5/1986
JP 402061382 A 3/1990
JP 05288171 A 11/1993
JP 407259764 A 10/1995
JP 09-032752 2/1997
JP 10-061567 3/1998
JP 410148191 A 6/1998
JP 2000-205152 7/2000
JP 2001020881 A 1/2001
JP 2001271752 A 10/2001
JP 2002021729 A 1/2002
JP 2002098056 A 4/2002

* cited by examiner

COMPRESSOR MOUNTING BRACKET AND METHOD OF MAKING

CROSS REFERENCE TO RELATED APPLICATIONS

This application claims priority under 35 U.S.C. 119(e) of U.S. provisional patent application Ser. No. 60/412,884 filed on Sep. 23, 2002 entitled COMPRESSOR MOUNTING BRACKET AND METHOD OF MAKING the disclosure of which is hereby incorporated by reference.

BACKGROUND OF THE INVENTION

1. Field of the Invention

The present invention relates to mounting brackets and, more specifically, to mounting brackets for compressors.

2. Description of the Related Art

A variety of different mounting methods are known for mounting compressors including compressors having an hermetically sealed housing. Some mountings are designed to absorb vibrations caused by the compressor. Such mountings may be relatively complex and add to the expense of the compressor. Other mountings are designed to provide an effective and cost efficient support for the compressor. Many compressors have hermetically sealed housings and mountings for such compressors must be secured to the housing in a manner which does not violate the hermetic seal.

An improved, cost efficient and effective mounting for compressors, including compressors having an hermetically sealed housing, is desirable.

SUMMARY OF THE INVENTION

The present invention provides an improved cost efficient and effective mounting for a compressor, including compressors having hermetically sealed housings.

The invention comprises, in one form thereof, a mounting bracket for a compressor having a housing wherein the mounting bracket includes a mounting member and an elongate member. The mounting member is secured to the housing and has a central support section in substantial registry with the housing and first and second legs extending from opposite ends of the arcuate section. The first and second legs include first and second distal portions respectively extending from the first and second legs. Each of the first and second distal portions respectively define an angle with the first and second legs. The elongate bracing member extends between first and second ends. A first swaged connection between the bracing member proximate its first end and the first distal portion and a second swaged connection between the bracing member proximate its second end and the second distal portion securely engages the bracing member and the mounting member. The first and second swaged connections each define an aperture in a respective one of the first and second distal portions of the mounting member.

The invention comprises, in another form thereof, a compressor assembly which includes an hermetically sealed compressor housing having an exterior surface, a compressor mechanism disposed within the housing, and a mounting bracket which includes a mounting member and an elongate bracing member. The mounting member is secured to the housing and has a central arcuate section in registry with the exterior surface of the housing. The mounting member also includes first and second legs extending from opposite sides of the arcuate section with the first and second legs including first and second distal portions respectively extending from said first and second legs. The bracing member extends between first and second ends. There is a first connection between the bracing member proximate its first end and the first distal portion wherein at least one of the bracing member and the first distal portion has been deformed into secure engagement with the other of the bracing member and the first distal portion. There is a second connection between the bracing member proximate its second end and the second distal portion wherein at least one of the bracing member and the second distal portion has been deformed into secure engagement with the other of the bracing member and the second distal portion. The housing may be substantially cylindrical and have an axis which is oriented substantially horizontal.

The mounting assembly may also include a second mounting bracket having a second mounting member and a second elongate bracing member. The second mounting member is secured to the housing and has a second arcuate section which is in registry with the exterior surface of the housing. The second mounting member also includes third and fourth legs which extend from the opposite ends of the second arcuate section. Third and fourth distal portions respectively extend from the third and fourth legs. The second bracing member extends between third and fourth ends. There is a third connection between the second bracing member proximate its third end and the third distal portion wherein at least one of the bracing member and the third distal portion are deformed into secure engagement with the other of the bracing member and the third distal portion. There is a fourth connection between the second bracing member proximate its fourth end and the fourth distal portion wherein at least one of the bracing member and the fourth distal portion are deformed into secure engagement with the other of the bracing member and the fourth distal portion.

The invention comprises, in yet another form thereof, a method of mounting an hermetically sealed compressor having a housing. The method includes providing a mounting member wherein the mounting member has a central support section and first and second legs extending from opposite ends of the support section. The first and second legs include first and second distal portions respectively extending at an angle from the first and second legs. The mounting member is secured to the housing wherein the support section is in registry with the housing. An elongate bracing having a first end and an opposite second end is also provided. The elongate bracing member is secured to the mounting member to form a mounting bracket by fixedly engaging the bracing member proximate its first end with the first distal portion of the mounting member by deforming at least one of the bracing member and the first distal portion into engagement with the other of the bracing member and the first distal portion and by fixedly engaging the bracing member proximate its second end with the second distal portion of the mounting member by deforming at least one of the bracing member and the second distal portion into engagement with the other of the bracing member and the second distal portion. In one form of this method, the mounting member is secured to the housing prior to securing the elongate bracing member to the mounting member.

The method may also include providing a second mounting member wherein the second mounting member has a second central support section and third and fourth legs extending from opposite ends of the second support section. The third and fourth legs include third and fourth distal portions respectively extending at an angle from the first and second legs. The second mounting member is secured to the housing with the second support section in registry with the housing. A second elongate bracing having a third end and an opposite fourth end is also provided. The second elongate bracing member is secured to the second mounting member to form a second mounting bracket by fixedly engaging the second bracing member proximate its third end with the third distal portion of the second mounting member by deforming at least one of the second bracing member and the third distal portion into engagement with the other of the second bracing member and the third distal portion and by fixedly engaging the second bracing member proximate its fourth end with the fourth distal portion of the second mounting member by deforming at least one of the second bracing member and the fourth distal portion into engagement with the other of the second bracing member and the fourth distal portion. In one form of this method, the mounting member and the second mounting member are both secured to the housing prior to securing the bracing member to the mounting member and securing the second bracing member to the second mounting member.

The method may also include providing a plurality of bent tabs on the first and second distal portions and positioning the first and second ends of the bracing member adjacent the bent tabs.

An advantage of the present invention is that by providing a mounting bracket which utilizes a relatively slim mounting member which is strengthened with a bracing member, the resulting mounting bracket allows for the effective and relatively inexpensive mounting of a compressor.

Another advantage of the present invention is that the use of a swaged connection between the bracing member and the mounting member, or a connection wherein at least one of the bracing member or mounting member is deformed into engagement with the other of the bracing member or mounting member, provides a secure, easy to manufacture connection between the bracing member and the mounting member which avoids the warping that can be associated with the joining of two relatively thin parts by welding.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
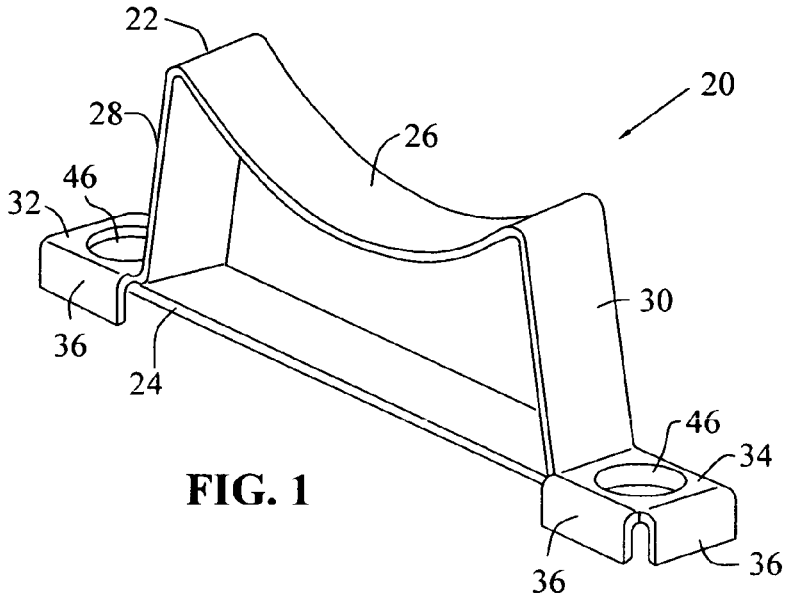
FIG. 1 is a perspective view of a mounting bracket in accordance with the present invention.
Figure 2:
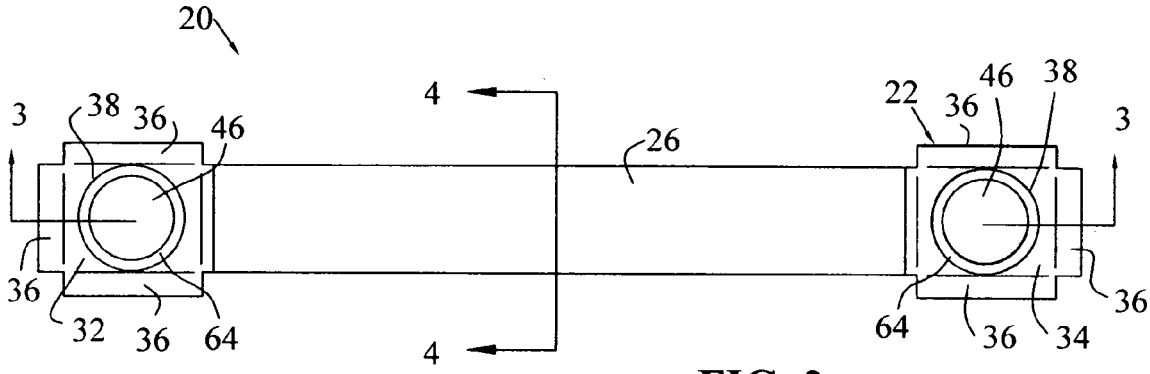
FIG. 2 is a plan view of the mounting bracket of FIG. 1.

Corresponding reference characters indicate corresponding parts throughout the several views. Although the exemplification set out herein illustrates embodiments of the invention, in multiple forms, the embodiments disclosed below are not intended to be exhaustive or to be construed as limiting the scope of the invention to the precise forms disclosed.

DESCRIPTION OF THE PRESENT INVENTION

A mounting bracket 20 in accordance with the present invention is shown in FIG. 1. Mounting bracket 20 includes a mounting member 22 and bracing member 24. Mounting member 22 has a central arcuate section 26. First and second legs 28, 30 extend from opposite ends of arcuate section 26 which forms a support section. First and second distal portions 32, 34 extend outwardly from and at an angle to first and second legs 28, 30. The distal portions 32, 34 of mounting member 22 each include a plurality of downwardly bent tabs 36. Bent tabs 36 provide rigidity to distal portions 32, 34. Bent tabs 36 also define a lowermost portion of mounting bracket 20 and thereby provide a bearing structure which may be engaged with a base surface (not shown) and thereby support mounting bracket 20 on the base surface. Each of the distal portions of mounting member 22 also includes an opening 38.

Figure 3:
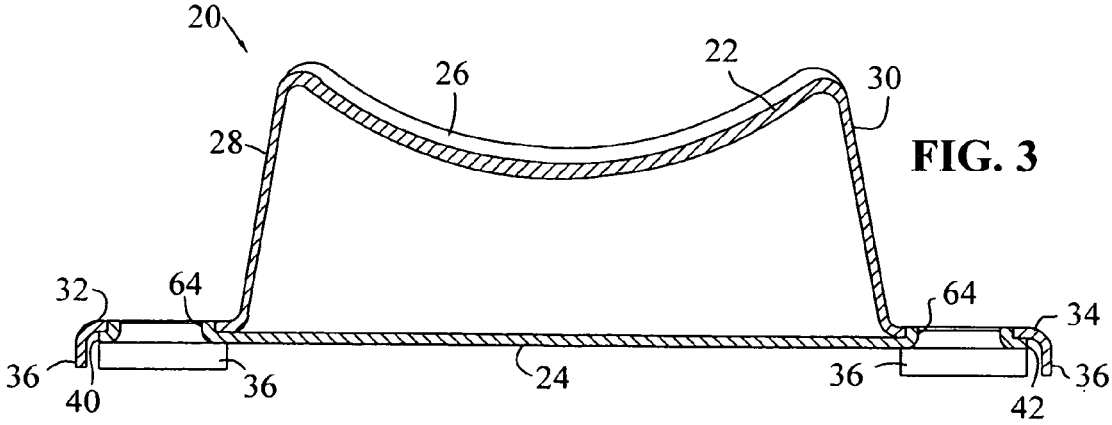
FIG. 3 is a sectional view taken along line 3—3 of FIG. 2.
Figure 4:
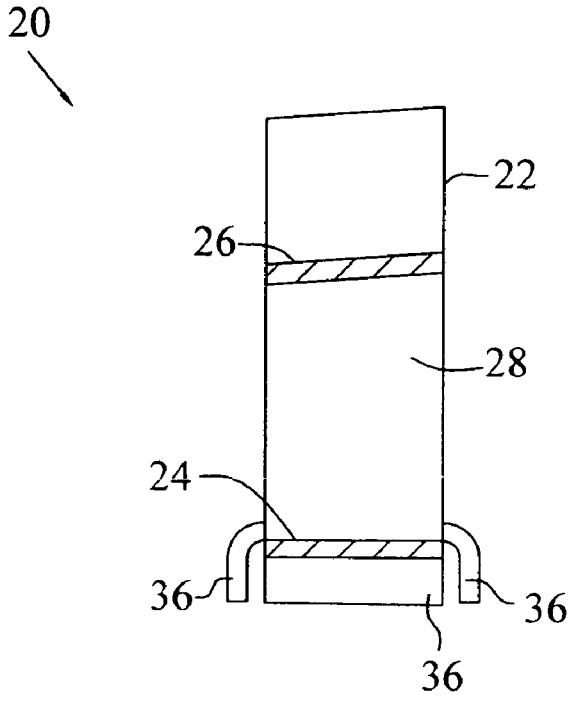
FIG. 4 is a side view of the mounting bracket taken along line 4—4 of FIG. 2.
Figure 8:
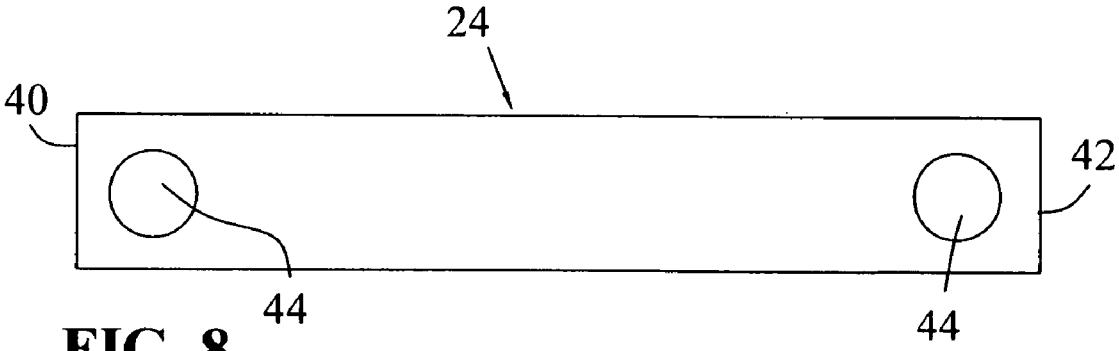
FIG. 8 is top view of a bracing member.

Bracing member 24 is a substantially planar, substantially rectangular member and is illustrated in FIG. 8. Bracing member 24 includes a first end 40 and a second end 42. An opening 44 is located proximate both ends 40, 42 of bracing member 24. Openings 44 have a smaller diameter than openings 38. As best seen in FIG. 3, bracing member 24 is secured to mounting member 22 by deforming those portions of bracing member 24 which are located proximate ends 40, 42 and which surround openings 44 upwardly and outwardly to engage the inner surface of openings 38 located in distal portions 32, 34. Distal portions 32, 34 are positioned in a substantially collinear and spaced configuration whereby the planar rectangular bracing member 24 may be overlappingly engaged with each distal portion 32, 34. The swaged connection between bracing member 24 and distal portions 32, 34 define apertures 46 which extend through both bracing member 24 and distal portions 32, 34. The attachment of bracing member 24 to mounting member 22 is discussed in greater detail below.

The attachment of bracing member 24 to mounting member 22 provides additional strength and rigidity to mounting bracket 20. Alternative configurations of mounting bracket 20 could also include a mounting member wherein all or part of the lateral edges of the brackets were transversely bent to provide a strengthening flange along the edges of the mounting member. Similarly, alternative bracing members could include transversely bent edges to increase the strength of the bracing member. Such bent edges, however, would add additional steps to the manufacture of mounting bracket 20.

In the illustrated embodiments, bracing member 24 and mounting member 22 are both formed from a sheet material. For example, a carbon steel, SAE HR 1010 may be used to form bracing member 24 and mounting member 22. Although bracing member 24 is substantially planar, mounting member 22 must be formed into its final configuration and thus takes the form of a bent sheet material.

Figure 5:
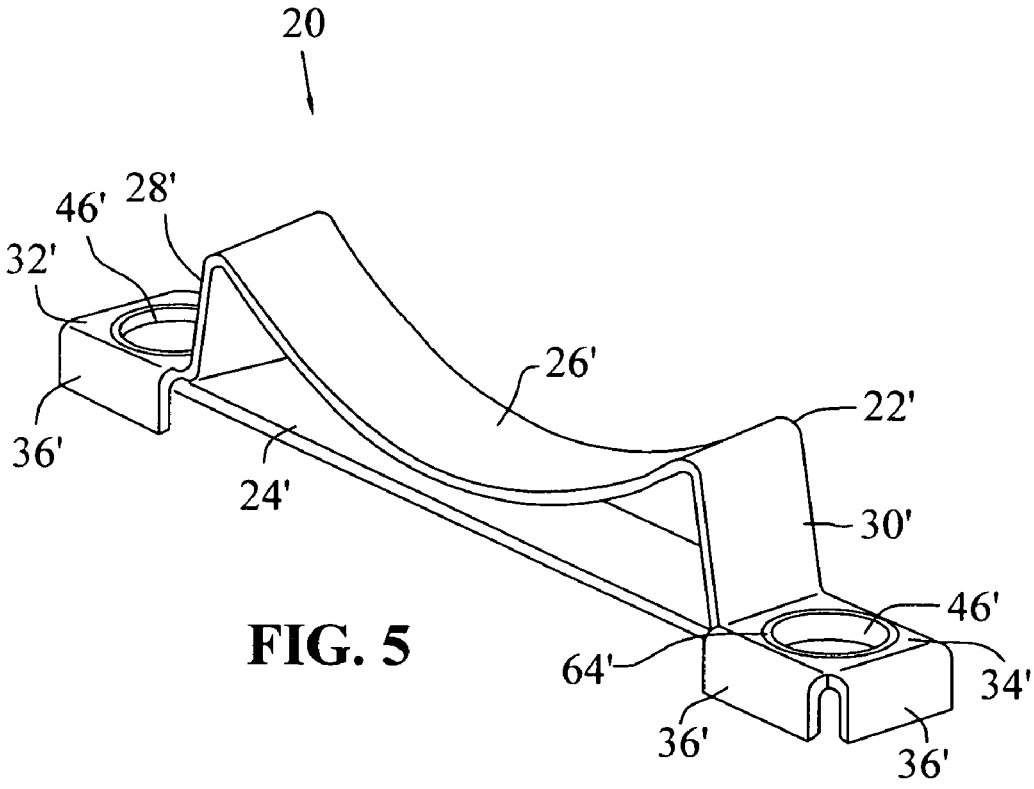
FIG. 5 is a perspective view of another mounting bracket in accordance with the present invention.

FIG. 5 illustrates a second mounting bracket 20' which is similar to mounting bracket 20 except for the length of the legs of mounting bracket 20'. The reference numerals used with mounting bracket 20' correspond to the reference numerals used with mounting bracket 20 but are prime reference numerals. The individual features of mounting bracket 20' are similar to those of mounting bracket 20 and the description of these common features which is presented above has not been repeated for mounting bracket 20'.

Figure 6:
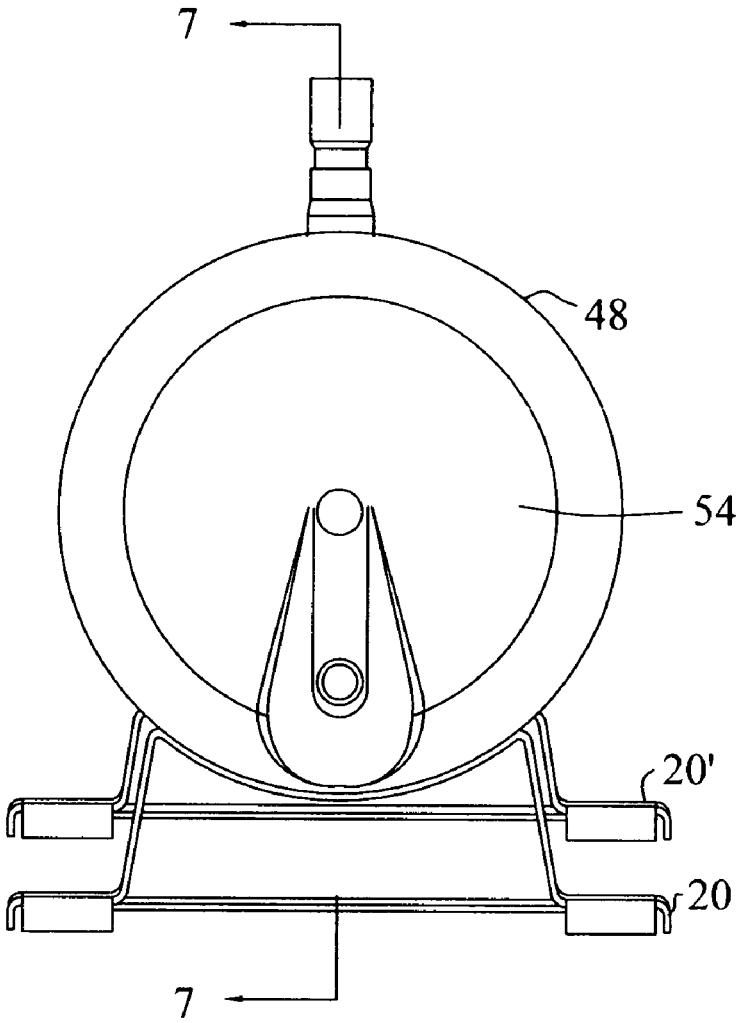
FIG. 6 is an end view of a compressor having a housing with the mounting brackets of FIGS. 1 and 5 attached thereto.
Figure 7:
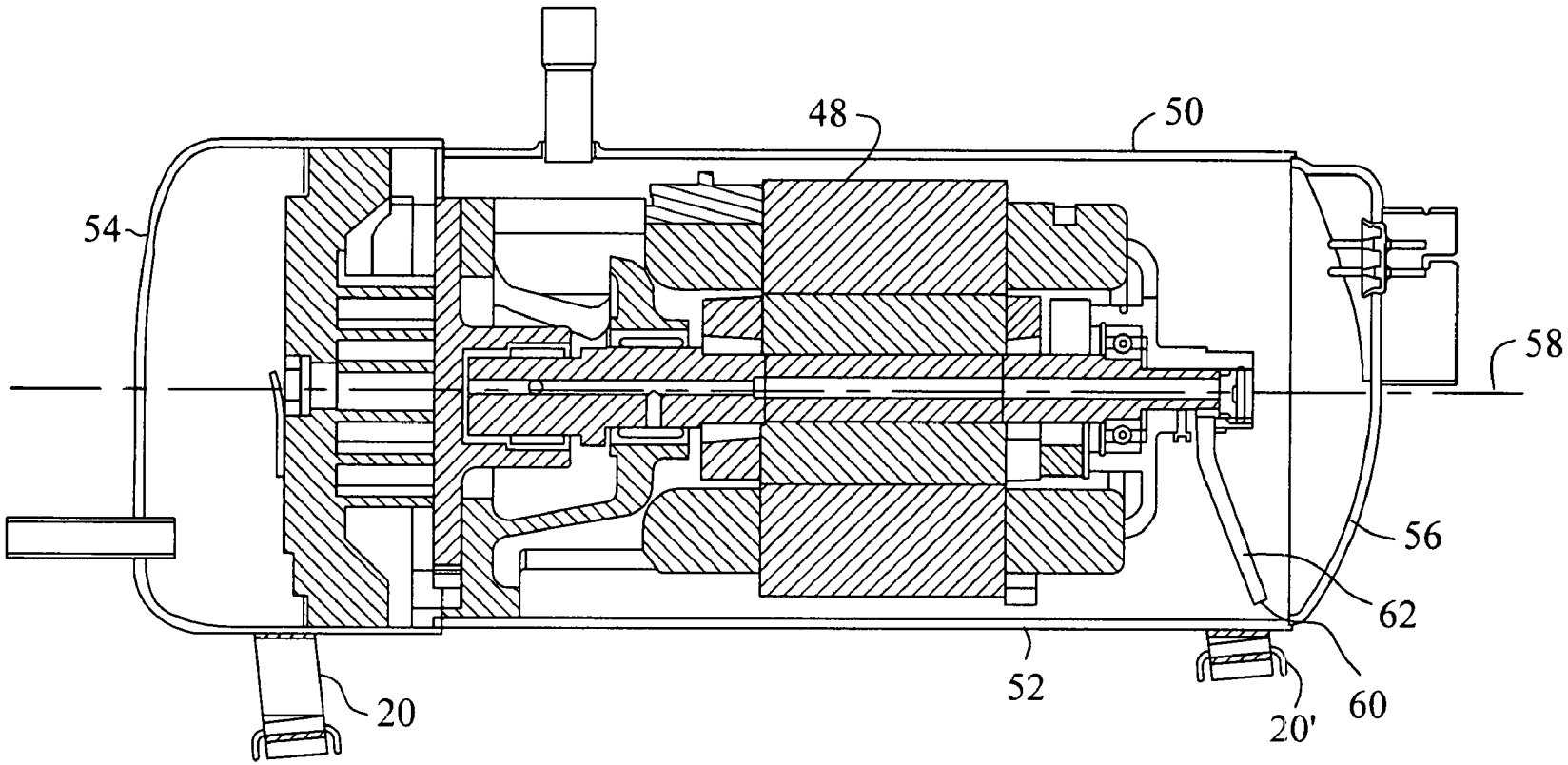
FIG. 7 is a sectional view taken along line 7—7 of FIG. 6.

FIGS. 6 and 7 illustrate mounting brackets 20, 20' secured to a compressor 48. Although illustrated compressor assembly 48 is a scroll compressor, the mounting brackets of the present invention may also be used with other types of compressors such as rotary compressors. Examples of compressor assemblies which may be used with mounting brackets 20, 20' are described by Haller et al. in U.S. Provisional Patent Application Ser. No. 60/412,768 entitled COMPRESSOR ASSEMBLY filed on Sep. 23, 2002 which is hereby incorporated herein by reference; by Skinner in U.S. Provisional Patent Application Ser. No. 60/412,868 entitled COMPRESSOR HAVING ALIGNMENT BUSHINGS AND ASSEMBLY METHOD filed on Sep. 23, 2002 which is hereby incorporated herein by reference; by Haller in U.S. Provisional Patent Application Ser. No. 60/412,890 entitled COMPRESSOR HAVING BEARING SUPPORT filed on Sep. 23, 2002 which is hereby incorporated herein by reference; by Skinner in U.S. Provisional Patent Application Ser. No. 60/412,871 entitled COMPRESSOR DISCHARGE ASSEMBLY filed on Sep. 23, 2002 which is hereby incorporated herein by reference; by Haller et al. in U.S. Provisional Patent Application Ser. No. 60/412,905 entitled COMPRESSOR HAVING DISCHARGE VALVE filed on Sep. 23, 2002 which is hereby incorporated herein by reference; and by Skinner in U.S. Provisional Patent Application Ser. No. 60/412,838 entitled COMPRESSOR HAVING COUNTERWEIGHT SHIELD filed on Sep. 23, 2002 which is hereby incorporated herein by reference. Compressor assembly 48 includes a housing 50 which provides an hermetic seal for compressor 48 in a manner which is well known in the art. Housing 50 includes a generally cylindrical portion 52 and two end caps 54, 56.

Mounting brackets 20, 20' are both secured to cylindrical portion 52 of housing 50. Arcuate sections 26, 26' both define a portion of a cylinder having the same radius as cylindrical portion 52 and are in substantial registry with cylindrical portion 52 when secured thereto. As best seen in FIG. 7, compressor assembly 48 and cylindrical housing 50 have a common axis 58. Axis 58 also defines the axis of the cylinder which is partially defined by arcuate surfaces 26, 26'. In other words, arcuate surfaces 26, 26' each define a portion of a cylinder having a common axis 58.

Compressor assembly 48 is horizontally oriented and, when mounted for operation, axis 58 is positioned at a slight incline. When mounted for operation, bent tabs 36, 36' of mounting brackets 20, 20' will be positioned in a common horizontal plane. Because legs 28, 30 are longer than legs 28', 30', axis 58, although substantially horizontal, will be positioned at an incline. In this configuration, legs 28, 30, 28', 30' are all disposed at a common angle to axis 48 which is a non-perpendicular angle. This positioning of compressor facilitates the collection of oil proximate intake 60 of oil pick-up tube 62. Alternative mounting brackets which mount a compressor at a different orientation or which mount a compressor having an alternatively shaped housing may also be used.

The assembly of mounting brackets 20, 20' and their securement to housing 50 will now be described. First, mounting members 22, 22' are positioned on housing 50 with support sections 26, 26' in registry with housing 50 and welded thereto using conventional welding procedures. Housing 50 along with attached mounting members 22, 22' may then be painted prior to attachment of bracing members 24, 24'. Bracing members 24, 24' are also painted prior to their attachment to mounting members 22, 22'.

Bracing members 24, 24' are then placed in registry with mounting members 22, 22' with ends of bracing members positioned adjacent bent tabs 36 and with openings 44 concentric with openings 38. Bracing members 24, 24' are then swaged into engagement with distal ends 32, 34; 32', 34' with a manually operated power tool which forces a reciprocating rod or similar tool component into openings 44 and thereby outwardly deforms bracing members 24, 24' into engagement with distal ends 32, 34; 32', 34'. As can be seen in FIG. 3, after being swaged into engagement with mounting member 22, bracing member 24 the resulting mechanical deformation of bracing member 24 results in upturned edges 64 which firmly engage the interior surface of opening 38 in mounting member 22 and surround and define apertures 46. Apertures 46, 46' formed by the swaging operation may be used to facilitate the attachment of the compressor to a base surface. For example, resilient feet could be secured to mounting brackets at apertures 46, 46' to resiliently support the compressor on a base surface and facilitate the dampening of vibrations. The shank of a bolt could also be passed through apertures 46, 46' to thereby securely fasten the mounting brackets to a base surface.

Alternative mounting brackets could employ distal ends which are deformed into engagement with the bracing member or both the bracing member and the mounting member could be at least partially deformed into engagement with the other to thereby secure the bracing member to the mounting member.

While this invention has been described as having an exemplary design, the present invention may be further modified within the spirit and scope of this disclosure. This application is therefore intended to cover any variations, uses, or adaptations of the invention using its general principles.

What is claimed is:

1. A compressor assembly comprising:

an hermetically sealed compressor housing having an exterior surface;

a compressor mechanism disposed within said housing;

a mounting bracket having a mounting member and an elongate bracing member;

said mounting member secured to said housing and having a central arcuate section in registry with said exterior surface of said housing and first and second legs extending from opposite ends of said arcuate section, said first and second legs including first and second distal portions respectively extending from said first and second legs;

said bracing member extending between a first end and an opposite second end, said bracing member secured to said mounting member at first and second connections, said first connection being between said bracing member proximate said first end and said first distal portion wherein at least one of said bracing member and said first distal portion has been deformed into secure engagement with the other of said bracing member and said first distal portion and said second connection being between said bracing member proximate said second end and said second distal portion wherein at least one of said bracing member and said second distal portion has been deformed into secure engagement with the other of said bracing member and said second distal portion.

2. The compressor assembly of claim 1 wherein said housing is substantially cylindrical and has a central axis which is oriented in a substantially horizontal position.

3. The compressor assembly of claim 2 further comprising a second mounting bracket having a second mounting member and a second elongate bracing member;

said second mounting member secured to said housing and having a second central arcuate section in registry with said exterior surface of said housing and third and fourth legs extending from opposite ends of said second arcuate section, said third and fourth legs respectively including third and fourth distal portions respectively extending from said third and fourth legs;

said second bracing member extending between a third end and an opposite fourth end, said second bracing member secured to said second mounting member at third and fourth connections, said third connection being between said second bracing member proximate said third end and said third distal portion wherein at least one of said second bracing member and said third distal portion has been deformed into secure engagement with the other of said second bracing member and said third distal portion and said fourth connection being between said second bracing member proximate said fourth end and said fourth distal portion securely engaging said second bracing member and said second mounting member wherein at least one of said second bracing member and said fourth distal portion has been deformed into secure engagement with the other of said second bracing member and said fourth distal portion.

4. The compressor assembly of claim 1 wherein said mounting member is welded to said housing.

5. The compressor assembly of claim 1 wherein said bracing member is a substantially planar, substantially rectangular member.

6. The compressor assembly of claim 5 wherein said mounting member is formed from a bent sheet material.

* * * * *